United States Patent [19]

Vuollet

[11] Patent Number: 4,834,155

[45] Date of Patent: May 30, 1989

[54] CHIPPER

[76] Inventor: Martti Vuollet, SF-61800 Kauhajoki, Finland

[21] Appl. No.: 154,250

[22] PCT Filed: Apr. 30, 1987

[86] PCT No.: PCT/FI87/00059

§ 371 Date: Feb. 10, 1988

§ 102(e) Date: Feb. 10, 1988

[87] PCT Pub. No.: WO87/06520

PCT Pub. Date: Nov. 5, 1987

[30] Foreign Application Priority Data

May 2, 1986 [FI] Finland ..... 861853

[51] Int. Cl.[4] ..... B27L 11/02; B27C 1/08

[52] U.S. Cl. ..... 144/176; 144/162 R; 241/277

[58] Field of Search ..... 241/277; 144/162 R, 144/163, 176, 218

[56] References Cited

U.S. PATENT DOCUMENTS

| | | | |
|---|---|---|---|
| 3,727,504 | 4/1973 | Osterholt | 144/162 R |
| 4,053,004 | 10/1977 | Barwise et al. | 144/162 R |
| 4,431,039 | 2/1984 | Barwise et al. | 144/176 |
| 4,607,672 | 8/1986 | Kangas et al. | 144/162 R |

*Primary Examiner*—W. Donald Bray

*Attorney, Agent, or Firm*—Armstrong, Nikaido, Marmelstein & Kubovcik

[57] ABSTRACT

Chipper for chipping of wood into chips suitable for defibrizing. The basic construction of the chipper consists of a horizontal shaft supported by a frame structure as well as of a blade disc mounted on the shaft in a vertical plane. The blade that performs the chipping is mounted on one side of the blade disc or, alternatively, on both vertical side faces of the disc. The blade projects from the side face of the blade disc perpendicularly and runs on the side face of the blade disc as a continuous narrowing spiral starting from the periphery of the blade disc. As the cutting edge of the blade becomes more distant form the periphery of the blade disc, it simultaneously also becomes more distant from the plane of the blade disc while following a screw line. The length of the chips to be chipped is determined by the spiral pitch of the blade edge, i.e. by the relative distance between two radial points on the blade edge. For the purpose of determining the chip thickness, on the chipper blade (4), cutting teeth (10directed towards the shaft have been placed one after the other as uniformly spaced, the front edge of the said teeth being sharpened.

3 Claims, 3 Drawing Sheets

CHIPPER

Figure 1:
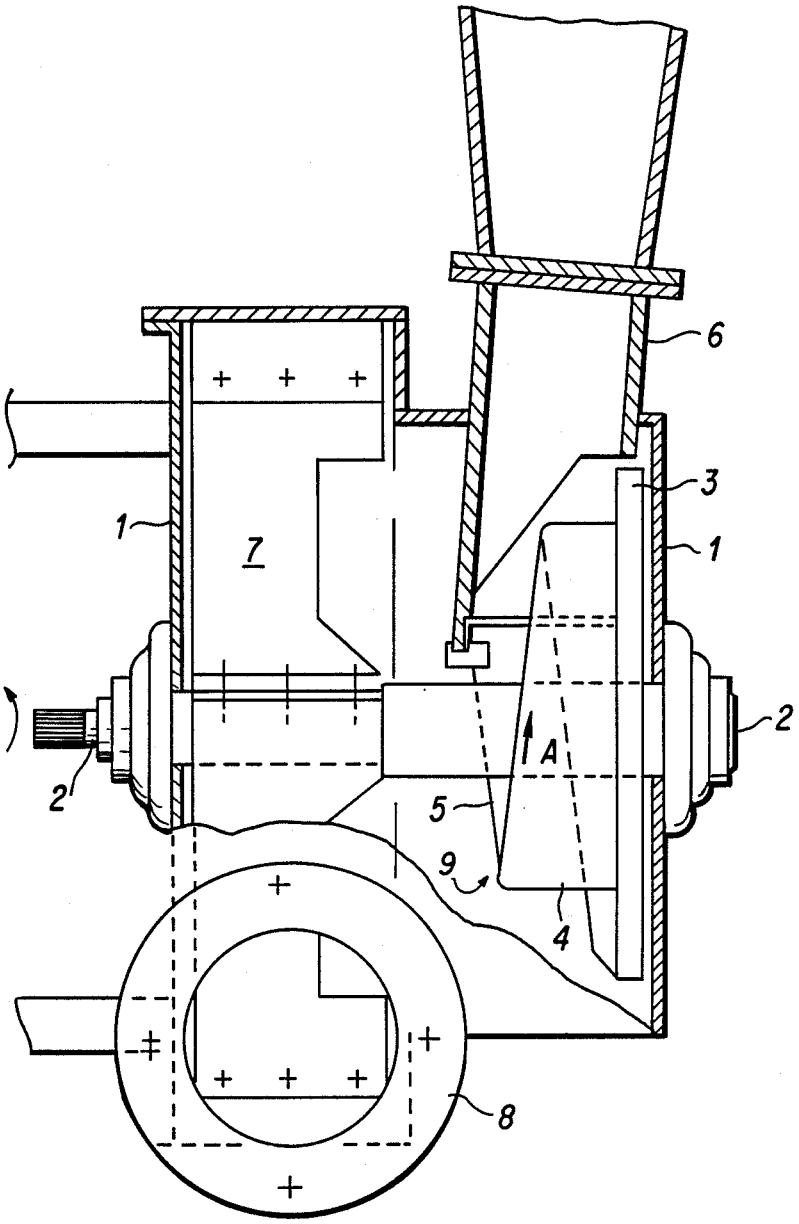

The subject of the present invention is a chipper for the chipping of wood into wood chips. In particular the invention relates to a basic type of a chipper which can be characterized as a radial spiral chipper and whose basic construction is described, e.g., in the published International Patent Application No. WO 84/02871.

It is characteristic of the said chipper type that the wood to be chipped is fed to the chipping members in a radial direction relative the blade disc. In this chipper type, the chipping of the wood is carried out by a continuous spiral blade whose cutting edge runs apart from the blade disc in screw line form, at the same time as it, starting from the periphery of the blade disc, approaches the centre of the blade disc. A recommended constructional form of the blade extends by about one and a half revolutions around the shaft of the blade disc, within which said path of travel the screw-shaped departing of the blade from the blade disc is arranged so that it produces a full "stroke" of the blade in the shaft direction, i.e. during the one and a half revolutions the blade wipes once across the feed opening of the chipper in the direction of the shaft.

If the chipper is constructed so that its shaft is placed horizontally, which is the recommended embodiment, the blade meets the wood first by reaching a tangential contact with one side of the wood, and thereat at a very sharp angle relative the vertical plane, which said angle is determined by the pitch angle of the departing of the blade edge from the blade disc.

The dimensioning of such a blade starts from the desired chip length and from the chosen pitch angle of the blade edge. If these factors have been chosen, the stroke length of the blade, i.e. the maximum thickness of the wood to be chipped, is determined by the blade diameter and blade length. As a rule, out of production-technical reasons and out of reasons of strength, it is not advisable to wind the blade to a spiral of very little radius, i.e. so that it revolves several times around the axis, but an adequate stroke length is preferably provided by means of a blade disc of somewhat larger diameter and by means of a blade wound on the disc with a larger radius. The distance in the radial direction between the blades in the blade spiral determines the length of the chips.

The said chipper type has been used successfully, e.g., for the production of fuel chips, in which case the chips are made rather coarse intentionally. The coarseness has been determined by choosing the radial spiral spacing of the blade, i.e., at the same time, the chip length large. Owing to the mode of operation of the chipper, large chip length at the same time also means high thickness of the chips. In order that the chips could be detached, it is necessary that the blade penetrating into the wood transversely to the grain in the radial direction has a force component in the direction of the grain which is sufficiently high to cleave the chip apart. For a long chip a higher detaching force is required than for a short chip, so that in the case of a long chip the blade has time to penetrate into the wood deeper before the chip is split apart.

The chipper may also be used for the production of chips to be defibrized, in which case the chip length is chosen clearly shorter. A usable chip length in the production of chemical pulp and refined groundwood is of an order of about 40 mm. However, in view of the absorption of the defibrizing chemicals, the chip thickness has a higher significance, and the thickness ought to be about 5 mm. However, the most essential matter in the control of the defibrizing process would be that the dimensions of all the chips are equal, i.e. the scattering of the dimensions of the chips should be as little as possible. Attempts have been made to reach this goal by means of a number of chipper solutions, but the scattering in the chip dimensions is still disturbingly high. The goal has been reached best in respect of the chip length, but the splitting of the chip apart from the wood during the chipping is still difficult to control and mainly a random process. This is in particular caused by irregularities in the wood structure.

If a chipper in accordance with the prior-art technology described above is used for chipping, herein the chip length can also be determined quite accurately, because it is determined by the radial spacing of the blade parts that form the spiral. On the contrary, the chip thickness is determined largely randomly. In this prior-art chipper type the detaching of the chip is caused mainly by the shear force component in the direction of the grain produced by the blade, the magnitude of the said component depending on the depth of penetration of the cutting edge of the blade in the transverse direction to the grain. If the wood material at the chip that is being detached happens to be strong, a correspondingly higher force in the direction of the grain is required for splitting, i.e. the blade must penetrate into the wood deeper thann at a weaker portion of wood, whereby the chip becomes thicker accordingly. Inversely, at a weaker portion of wood, the chip is already detached with a less deep penetration of the blade, and the chip becomes thin.

The procedure is exactly contrary to the result that is aimed at. Strong wood material is also dense, so that the defibrizing chemicals are absorbed into it poorly. Moreover, as the chip is thick, such a chip requires a considerable time for complete absorption. Correspondingly, the chip from a weak portion of wood is thin and brittle, whereby it is saturated with chemicals rapidly. Thus, the scattering in the absorption result is increased significantly.

Besides uniform chip length, the chipper in accordance with the present invention can also provide uniform chip thickness by means of the constructional characteristics of the chipper, which come out from the accompanying claim 1. Moreover, by adjusting the construction of the chipper it is possible to choose the length and thickness of chip as desired within usable limits.

Figure 2:
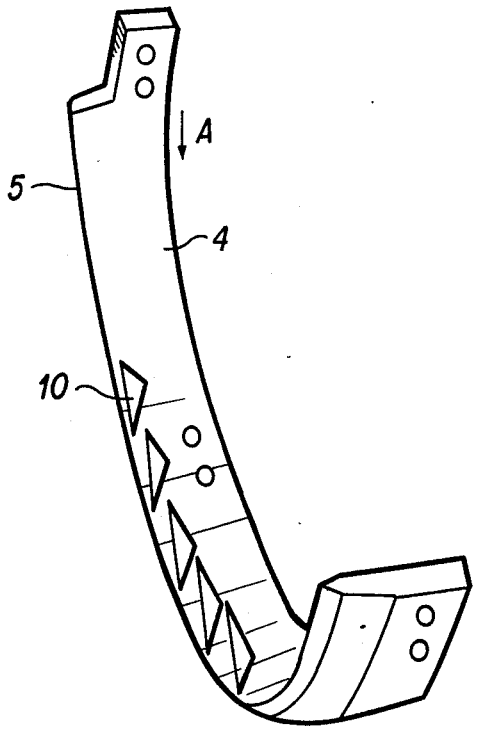
Figure 3:
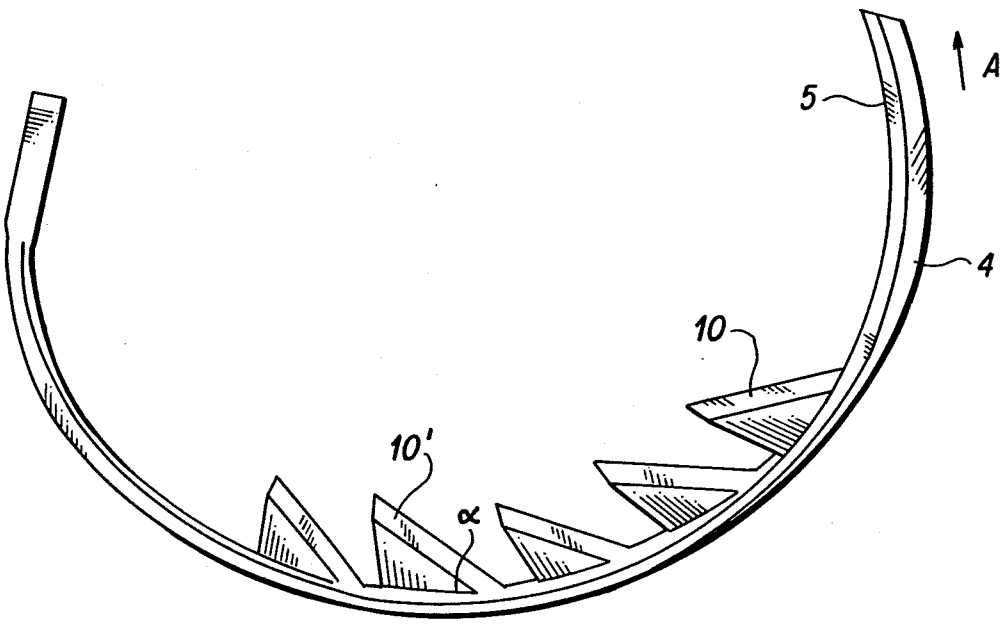

The invention will be described with reference to the accompanying drawing, wherein FIG. 1 shows a chipper in accordance with the invention as a top view with a part of the chipper housing removed, FIG. 2 shows a section of the blade piece of a chipper in accordance with the invention as an embodiment illustrating the priniciple, with part of the cutter teeth removed, and FIG. 3 shows the same blade piece section on an enlarged scale and viewed in the direction of the shaft of the chipper.

The chipper shown in FIG. 1 is provided with a horizontal shaft 2 journalled on a box-like frame construction 1, which said shaft obtains its operating power from a suitable power source. A circular blade disc 3 is mounted centrally on the shaft 2, and the blade 4 that performs the chipping is fixed onto the blade disc. The blade starts substantially from the circumference of the blade disc, at which its projection from the blade disc is least. From its starting point on the circumference of the blade disc, the blade winds in spiral form around the shaft with a decreasing radius, whereat, at the same time, its cutting edge 5 becomes more distant from the blade disc in the form of a screw line. In the embodiment shown, the blade 4 is shown as revolving by about 1.5 revolutions around the shaft, which said distance can be considered advantageous in view of the balancing of the blade. Within this distance, the cutting edge 5 must perform one working stroke, i.e. it must wipe once across the feed opening.

The narrowing of the blade spiral is chosen in each particular case in accordance with the desired length of chip. The pitch angle of the cutting edge 5, and thereby also the stroke length of the blade of specified length, is chosen relatively steep relative the shaft of the chipper, whereby the blade meets the wood to be chipped so that it applies a high shearing effect but a little impact effect to the wood.

The wood to be chipped is fed into the chipper via a suitable feeding member, such as a feed trough 6. At the same time, the wall at the final end of the trough acts as a chipping counterpiece for the blade 4. The chipper may also have an exhaust blower 7 for the chips, which removes the chips through a pipe so as to be conveyed further. In stead of the onesided mounting of blade shown in FIG. 1, a corresponding blade may be mounted on the opposite side of the blade disc 3 as opposite-handed, in which case the feed opening must be enlarged in a corresponding way so as to extend to the areas of both blades. In such an installation, the blades may be mounted as of different phases on the blade disc so as to equalize the loading strains.

It is also possible that the blade is mounted on the blade disc 3 as a multiple spiral, such as as a double spiral of different phases, which may be preferable expressly in the case of pulp chips, because the dimensions of the chips are relatively short. In order to provide an adequate stroke length, it is also possible that, e.g., on a blade disc of a large diameter, the blade is rotated around the shaft 2 even more than the said one and a half revolutions.

The basic idea proper of the present invention comes out from FIG. 2 in the accompanying drawing, which shows a blade section extending approximately over half a revolution and having part of the cutting teeth 10 in position. In the overall illustration of FIG. 1, it might be possible to imagine that the said section is cut off, e.g., at point 9 and that the piece is viewed somewhat from the direction of the drive side of the shaft 2. In view of achieving the goal of the invention, successive cutting teeth 10 have been attached to the inside face of the blade 4 as uniformly spaced. In the embodiment shown in FIGS. 2 and 3, a cutting edge 10' has been provided at the front edge of the teeth by chamfering the left face of the teeth in FIG. 2, in the way shown better in FIG. 3. The teeth 10 are mounted on the blade diagonally in the way shown in FIG. 2 so that the chamfer face at the cutting edge 10' becomes placed in a plane substantially perpendicular to the shaft 2 of the chipper. It is of course also possible to produce the cutting edge by chamfering the other side of the tooth, in which case the unchamfered side of the tooth is mounted in a plane perpendicular to the shaft 2. In such a case the teeth are also positioned less diagonally relative the main blade, as compared with the embodiment shown in FIG. 2.

The relative distance between the teeth placed one after the other is chosen in view of the pitch of the main blade so that the overlapping of the teeth in the direction of the shaft of the chipper becomes equal to the desired thickness of the chips. The cutting edge 10' of the teeth 10 is arranged so that it starts substantially from the edge of the cutting edge 5 of the main blade, preferably, however, somewhat (about 2 mm) behind the edge 5. The cutting edge is also inclined rearwards relative the direction of progress of the blade, so that the edge forms an angle of 30° to 40° with the main blade. By means of this inclination, it has been achieved that the teeth do not collide against the side of the chip to be cut off over the whole length at the same time, but they detach the chip by carving it in the direction of its width. In this way the detaching of the whole chip has been accomplished by carving, which results in a very smooth operation of the chipper, because almost no impact effects are applied to the wood to be chipped.

In the chipper of the present invention, the chipping procedure starts when the initial end of the cutting edge 5 of the main blade 4 reaches tangential contact with the side face of the initial end of the log. The blade edge shears itself into the wood in accordance with its pitch transversely to the grain. The first blade tooth is placed in view of the desired chip thickness after the starting point of the main blade, in which case this first teeth carves in a plane perpendicular to the shaft 2 of the chipper, which said plane is parallel to the longitudinal direction of the log to be chipped, and detaches the first chip layer from the log in the vertical plane parallel to the grain, which said layer had been cut by the edge of the main blade, above off the log transversely to the grain. The next tooth carves a corresponding sprial layer apart from the log by one thickness of a chip deeper in the radial direction, etc. In this way spiral layers placed side by side in a plane in the fibre direction are cut apart from the wood in the transverse direction, the dimension of the said layers in the length direction of wood equalling the distance of the cutting edge 5 of the main blade as per phase of rotation in the radial direction of the blade disc 3 and the thickness equalling the overlapping of the blade teeth 10 in the axial direction of the chipper. These spiral bands are broken into pieces randomly and define the chip width in accordance with these breaking points.

In FIGS. 2 and 3 the chipper blade in accordance with the invention is shown such that it is put together out of blade sections to be fitted one after the other, whose number is, e.g., in the alternative shown three. The blade teeth 10 may be fixed to such a section by welding, or alternatively they may be attached to it, e.g., by screw fastenings in view of easier replacement of damaged teeth. It is also possible that the blade is composed of successive units which comprise, e.g., one tooth 10 and a related piece of main blade edge 5. Such units may be attached one after the other on a suitable spiral frame so as to make a complete blade.

As was stated above, a steel spiral may be placed at both sides of the blade disc 3, and also as a multiple spiral on the blade disc.

What is claimed is:

1. A radial spiral chipper for chipping pulp digesting wood chips of the type including a feed member, a chipping blade disc supported on a shaft for rotary movement, said chipping blade disc having at least one radial face normal to said shaft, at least one continuous chipping blade mounted on said chipping blade disc, said chipping blade having a cutting edge and projecting substantially perpendicular from said radial face of said chipping blade disc in the form of a spiral with the distance between said cutting edge and said radial face of said chipping blade disc increasing as said chipping blade approaches the central area of said chipping blade disc, a wall at an internal end of said feed member serving as a chipping counterpiece for said chipping blade, power means for rotating said shaft, a blower supported for rotation by said shaft, and an exhaust conduit permitting discharge of chips by said blower, wherein the improvement comprises:

a plurality of uniformly spaced cutting teeth mounted on a radially inner face of said chipping blade adjacent said cutting edge of said chipping blade, each of said cutting teeth projecting substantially radially inward and having a cutting edge facing the direction of rotation of said chipping blade, adjacent ones of said cutting teeth being positioned relative to each other with the cutting edge of each tooth oriented so that a surface of each cutting edge of each tooth that is spaced away from the blade disc rotates in a plane substantially parallel to said radial face of said chipping blade disc and the distance between said surfaces of the cutting edges of adjacent ones of said teeth determine the thickness of the chips produced.

2. A radial spiral chipper as defined by claim 1, wherein the cutting edge of each of said cutting teeth is inclined in a rearwardly directed angle relative to the direction of rotation of said chipping blade disc.

3. A radial spiral chipper as defined by claim 2, wherein said rearwardly directed angle is within the range of 30° to 40°.

* * * * *